US007828402B2

(12) United States Patent
Otsuka

(10) Patent No.: US 7,828,402 B2
(45) Date of Patent: Nov. 9, 2010

(54) DRIVING DEVICE FOR RECORDING HEAD, IMAGE RECORDING APPARATUS, AND DRIVING METHOD FOR RECORDING HEAD

(75) Inventor: Hiroyuki Otsuka, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 220 days.

(21) Appl. No.: 12/057,070

(22) Filed: Mar. 27, 2008

(65) Prior Publication Data

US 2008/0238963 A1 Oct. 2, 2008

(30) Foreign Application Priority Data

Mar. 30, 2007 (JP) ..... 2007-095519

(51) Int. Cl.
*B41J 29/38* (2006.01)

(52) U.S. Cl. ..... 347/10; 347/9

(58) Field of Classification Search ..... 347/10
See application file for complete search history.

(56) References Cited

U.S. PATENT DOCUMENTS

2006/0139412 A1* 6/2006 Sakurai et al. ..... 347/61

FOREIGN PATENT DOCUMENTS

JP 2006-159573 A 6/2006

* cited by examiner

*Primary Examiner*—Matthew Luu
*Assistant Examiner*—Brian J Goldberg
(74) *Attorney, Agent, or Firm*—Birch, Stewart, Kolasch & Birch, LLP

(57) ABSTRACT

The driving device of a recording head having a recording element, the driving device includes: a power supply device which supplies voltage to be applied to the recording element; an output circuit block which converts the voltage supplied from the power supply device into a drive voltage having a prescribed waveform, the output circuit block having a structure in which a plurality of drive circuit units are connected in parallel to the recording element; a recording data integration device which determines an integrated value of a number of recording actions of the recording element according to recording data; and a drive circuit unit selection device which selects at least one of the drive circuit units in accordance with the integrated value determined by the recording data integration device, in such a manner that an on-resistance value of the output circuit block is kept within a prescribed value.

15 Claims, 17 Drawing Sheets

FIG.11

| INTEGRATED IMAGE DATA | FIRST-STAGE DRIVE | SECOND-STAGE DRIVE | THIRD-STAGE DRIVE |
|---|---|---|---|
| – | ON | OFF | OFF |
| THRESHOLD VALUE 1 | ON | ON | OFF |
| THRESHOLD VALUE 2 | ON | ON | ON |

DRIVING DEVICE FOR RECORDING HEAD, IMAGE RECORDING APPARATUS, AND DRIVING METHOD FOR RECORDING HEAD

BACKGROUND OF THE INVENTION

1. Field of the Invention

The present invention relates to a driving device for a recording head, an image recording apparatus, and a driving method for a recording head, and more particularly to circuit technology for reducing distortion in the output waveform caused by temperature change in the drive circuit unit.

2. Description of the Related Art

In general, an inkjet recording apparatus, which forms a desired image by ejecting and depositing ink droplets from a plurality of nozzles provided in an inkjet head onto a recording medium, is widely used as a generic image forming apparatus. A known ejection method for the inkjet head in the inkjet recording apparatus is one where pressure generating elements, such as piezoelectric elements or heat generating elements, are provided at a plurality of pressure chambers, which are connected respectively to the nozzles, and an ejection force is applied to the ink inside the pressure chambers by applying a prescribed drive voltage to the pressure generating elements so as to operate the pressure generating elements.

As a method for driving the piezoelectric elements, it is suitable to use a common waveform method in which drive waveform elements contained in a common drive voltage corresponding to different ink ejection volumes are applied selectively to the piezoelectric elements by using analogue switches, a multiplexer, or the like, thereby varying the ejection volume of the ink droplets ejected from the nozzles.

In general, a DC power supply device (DC-DC converter) is suitable for use in supplying a drive voltage to a thermal type of head, which uses the heat generating elements, or to a piezoelectric type of head, which uses the piezoelectric elements, and a flexible flat cable (FFC) is suitable for connection between the DC power supply device and the head. Since the wires provided in the FFC have wiring resistance, then voltage drop occurs in the transmitted drive voltage, and for example, in a head that uses the heat generating elements, variation arises in the amount of heat generated by the heat generating elements, leading to a variation in the ink ejection volume, and therefore non-uniformities arise in the ink density in accordance with this variation in the ink ejection volume, and the quality of the recorded image deteriorates. Moreover, since the wires that transmit the drive voltage also have a capacitive component and an inductive component, in addition to the resistance component, then these components give rise to waveform distortion in the drive voltage. Various methods have been proposed in order to eliminate waveform distortion of this kind which occurs in the drive voltage.

Japanese Patent Application Publication No. 2006-159573 discloses a recording apparatus including a serial type of recording head, in which a drive power supply circuit supplying a drive power to a recording head from a DC-DC converter is provided in the main body of the recording apparatus, thereby supplying power and control signals to the recording head. The recording apparatus has, on a carriage, a carriage circuit board having terminals for determining the output voltage from the DC-DC converter, and in the DC-DC converter, a capacitor is connected between a ground terminal for supplying the drive power and a ground terminal for determining the output voltage. The ground terminal for supplying the drive power and the ground terminal for determining the output voltage are connected on the carriage substrate, in such a manner that the voltage drop due to the wiring resistance of the power supply wires is cancelled out, and hence a stable power that is free of oscillations or fluctuations is supplied to the recording head.

However, in the common drive waveform method described above, variation occurs in the on-resistances of the internal drivers (e.g., circuit units including MOSFETs (metal-oxide-semiconductor field-effect transistors)) of the switch IC that selectively applies a part of the common drive waveform corresponding to the pressure generating elements, and this variation affects the drive voltage applied to the pressure generating elements.

FIG. 14 shows a driving device of the pressure generating elements (e.g., piezoelectric elements in FIG. 14) in the related art. The driving device 500 shown in FIG. 14 includes: a DC-DC converter 504, which supplies drive power to a liquid ejection head (hereinafter, called "head") 502; a FFC 506, which connects the DC-DC converter 504 with the head 502; a shift register 512 and a latch circuit 514, which selectively apply the drive waveform generated by a common waveform generating unit (not shown) to the piezoelectric elements 510 on the basis of the image data; and a switch IC 518 including an output-stage push-pull circuit block 516. In FIG. 14, the resistance component and the inductive component contained in the wiring in the FFC 506 are denoted with reference numeral 520.

When a control signal corresponding to the image data is inputted to the switch IC 518, the switch IC 518 selects the drive waveform that is to be applied to each piezoelectric element 510 from the common drive waveform generated by the common waveform generating unit, and applies the drive voltage obtained by receiving the power supply from the DC-DC converter 504 and amplifying the power of the corresponding drive waveform, to the corresponding piezoelectric element 510.

A PWM (pulse width modulation) control method is used in the DC-DC converter 504 shown in FIG. 14. Although detailed description of the PWM control method is omitted here, in the DC-DC converter 504, the FET 511 is controlled by means of a pulse signal (modulated control signal) $V_P$ obtained by comparing the differential voltage (error voltage) $\Delta V$ between the output voltage $V_O$ and the reference voltage $V_{REF}$, with a sawtooth waveform voltage Vth, and the output voltage is maintained at a uniform voltage by applying a pulse width modulation is applied to the input voltage $V_{IN}$.

A smoothing circuit block constituted of a diode D, a coil L and a capacitor C provided on the downstream stage of the FET 511 supplies a voltage from the capacitor C while the FET 511 is on, and supplies a voltage from the diode D and the coil L while the FET 511 is off, thereby maintaining the output voltage $V_O$ at a uniform voltage. In other words, the DC-DC converter 504 generates a direct voltage (PWM waveform), and supplies the voltage to the switch IC 518 to drive the piezoelectric element 510.

In this case, since a peak current of the order of several amperes at maximum flows in the push-pull circuit block 516, which is located at the output stage of the switch IC 518, then the switch IC 518 generates heat as a result of this current. Hence, when the internal temperature is raised due to the heat generated by the switch IC 518, then the on-resistance ($R_{ON}$) of the drivers constituting the push-pull circuit block 516 becomes relatively large.

The temperature dependency of the on-resistance of a general MOSFET can be expressed as follows:

$$R=R_0\times(T/T_0)^{1.5},$$

where R is the on-resistance at temperature T, and $R_0$ is the on-resistance at temperature $T_0$ (reference temperature).

When the on-resistance of the switch IC 518 has become relatively large in this way, waveform distortion occurs in the drive voltage 520 shown in FIG. 15A, and the drive waveform 530 shown in FIG. 15B is obtained. More specifically, waveform rounding corresponding to the time constant represented by the product of the increase in the on-resistance and the electrostatic capacitance of the piezoelectric element 510 occurs, as shown in the rising part 532 and the falling part 534 in FIG. 15B, and looking in particular at the rising part 532, for example, it can be seen that the rise time, which is originally 1 microsecond in FIG. 15A, increases to 1.4 microseconds in FIG. 15B. When waveform rounding of this kind occurs, then a problem arises in that the ink droplet ejection characteristics change (the ejection speed becomes slower).

In Japanese Patent Application Publication No. 2006-159573, no attention is paid to the on-resistance of the driving circuit units, and therefore waveform distortion occurs in the drive voltage supplied to the inkjet recording head, due to the above-described change in the on-resistance, and deterioration in the ejection characteristics due to the change in the on-resistance cannot be avoided.

Furthermore, the on-resistance of the driver of the switch IC displays temperature dependency that also displays dependency on location. For example, a line type head 550 having a nozzle row of a length corresponding to the full width of the recording medium, such as that shown in FIG. 16 tends to have a higher temperature in the central portion than in the end portions, and a switch IC (not shown) located in the central portion of the head 550 therefore has a higher on-resistance than a switch IC (not shown) located in the end portion of the head 550. Accordingly, the drive voltage that is applied to the piezoelectric elements (not shown) in the central port of the head 550 has greater waveform rounding than the drive voltage that is applied to the piezoelectric elements (not shown) in the end portions of the head 550.

Consequently, the ink droplets ejected from the nozzles (554 to 560 in FIG. 16) in the central portion of the head 550 suffer a decline in the ejection speed. If the ejection speed falls, then landing position displacement occurs as indicated, for example, by the dots 562 and 564 formed by the ink droplets ejected from the nozzle 554 and nozzle 560, and thus, image non-uniformities occur. As shown in FIG. 17, taking the boundaries to be $\pm 1\sigma$ when the temperature distribution of the head 550 is taken to be a normal distribution, then the region inside these boundaries is defined as the central portion of the head and the regions outside these boundaries are defined as the end portions of the head.

SUMMARY OF THE INVENTION

The present invention has been contrived in view of the circumstances described above, an object thereof being to provide a driving device for a recording head, an image recording apparatus, and a driving method for a recording head, whereby desirable recording characteristics are maintained in a recording head by suppressing the occurrence of waveform distortions in the drive voltage which is applied to the recording elements.

In order to attain the aforementioned object, the present invention is directed to a driving device of a recording head having a recording element, the driving device comprising: a power supply device which supplies voltage to be applied to the recording element; an output circuit block which converts the voltage supplied from the power supply device into a drive voltage having a prescribed waveform, the output circuit block having a structure in which a plurality of drive circuit units are connected in parallel to the recording element; a recording data integration device which determines an integrated value of a number of recording actions of the recording element according to recording data; and a drive circuit unit selection device which selects at least one of the drive circuit units in accordance with the integrated value determined by the recording data integration device, in such a manner that an on-resistance value of the output circuit block is kept within a prescribed value.

According to this aspect of the present invention, since at least one drive circuit unit is selected in accordance with the recording data, from the plurality of drive circuit units provided in the output circuit block, in such a manner that the on-resistance value of the output circuit block is not more than the prescribed value, then the waveform rounding of the drive voltage applied to the recording elements, which is caused by increase in the on-resistance of the drive circuit units, is improved, and the recording characteristics of the recording elements are stabilized.

Furthermore, since the drive circuit units are selected in accordance with the number of the recording actions of the recording elements as calculated from the recording data, then even if there is a temperature rise in the recording elements due to increase in the number of the recording actions, waveform rounding of the drive voltage applied to the recording elements is suppressed and the recording characteristics of the recording elements are stabilized.

One mode of the drive circuit unit selection device which selects at least one drive circuit unit from the plurality of drive circuit units in such a manner that the on-resistance value of the output circuit block is equal to or less than the prescribed value is a mode where it is occasionally judged whether or not the on-resistance of the drive circuit units exceeds the prescribed value, and if it is judged that the on-resistance of the drive circuit units does exceed the prescribed value, then the number of recording elements is progressively increased.

The drive circuit unit includes a functional element provided in the output circuit block of the driving device (for example, an output element such as a MOSFET). For example, it is possible to compose the drive circuit unit by combining a plurality of functional elements, such as a push-pull circuit which combines two MOSFETs.

The recording head may be a liquid ejection head which ejects liquid from nozzles, or a head having recording elements, such as LEDs (light-emitting diodes).

Preferably, the driving device further comprises: a threshold value setting device which sets a threshold value with respect to the integrated value in accordance with a correlation between the integrated value and a temperature change in the drive circuit units, wherein the drive circuit unit selection device compares the integrated value with the threshold value set by the threshold value setting device and selects only one of the drive circuit units in a case where the integrated value is not more than the threshold value, and selects at least two of the drive circuit units in a case where the integrated value exceeds the threshold value in such a manner that the on-resistance value of the output circuit block is kept within the on-resistance value of the output circuit block when the only one of the drive circuit units is selected.

According to this aspect of the present invention, since the number of the selected recording elements arranged in parallel is increased in accordance with the integrated value of the number of recording actions, then it is possible to suppress increase in the on-resistance of the recording elements in accordance with the number of recording actions.

One example of the correlation between the integrated value and the temperature change in the drive circuit units is a correlation where the integrated value is directly proportional to the temperature (rise) of the drive circuit unit.

Preferably, the driving device further comprises: a temperature determination element which determines an ambient temperature; and a threshold value correction device which corrects the previously set threshold value to a smaller value, when the temperature determined by the temperature determination element is higher than a previously established reference temperature.

According to this aspect of the present invention, it is possible to respond to change in the ambient temperature of the driving device, and stable recording characteristics can be ensured, irrespective of change in the ambient temperature.

It is also possible to determine the ambient temperature at prescribed timings and to correct the threshold values in real time, accordingly. Furthermore, a desirable mode is one where the reference temperature is normal temperature (for example, 25° C.).

Preferably, the output circuit block has the structure in which three of the drive circuit units are connected in parallel to the recording element; the driving device further comprises a threshold value setting device which sets first and second threshold values with respect to the integrated value in accordance with a correlation between the integrated value and a temperature change in the drive circuit units, the second threshold value being larger than the first threshold value; and the drive circuit unit selection device compares the integrated value with the first and second threshold values set by the threshold value setting device and selects only one of the drive circuit units in a case where the integrated value is not more than the first threshold value, selects two of the drive circuit units in a case where the integrated value exceeds the first threshold value and is not more than the second threshold value in such a manner that the on-resistance value of the output circuit block is kept within the on-resistance value of the output circuit block when the only one of the drive circuit units is selected, and selects three of the drive circuit units in a case where the integrated value exceeds the second threshold value.

According to this aspect of the present invention, by setting the number of the drive circuit units connected in parallel to three, it is possible to restrict increase in the surface area occupied by the drive circuit units (the output circuit block), as well as allowing the on-resistance of the output circuit block to be switched between three levels, and hence the on-resistance value of the output circuit block can be optimized.

Preferably, the drive circuit units have the same on-resistance value.

According to this aspect of the present invention, the manufacturability of the driving device (and in particular, the output circuit block including the drive circuit units), is improved, and increase in production yield can be expected. Furthermore, the "same on-resistance" also includes prescribed error occurring during manufacture, or tolerable error in the circuit to which the drive circuit units are applied. In other words, reference to "the same resistance value" indicates a concept based on the same standard value (values within a prescribed allowable range of error).

In order to attain the aforementioned object, the present invention is also directed to an image forming apparatus comprising: the recording head which has the recording element recording an image onto a recording medium; a drive voltage generating device which generates a drive voltage to be applied to the recording element; and the above-described driving device to apply the drive voltage from the drive voltage generation device to the recording element.

According to this aspect of the present invention, the recording characteristics are stabilized by suppressing waveform rounding in the drive voltage applied to the recording elements, and therefore it is possible to obtain a desirable recorded image.

In order to attain the aforementioned object, the present invention is also directed to a driving method of a recording head having a recording element, comprising: a recording data integration step of determining an integrated value of a number of recording actions of the recording element according to recording data; an output element selection step of selecting at least one of a plurality of output elements in an output circuit block having a structure in which the output elements are connected in parallel to each of the recording elements, in accordance with the integrated value determined in the recording data integration step, in such a manner that an on-resistance value of the output circuit block is kept within a prescribed value; and a driving voltage application step of converting voltage supplied from a power supply device to a drive voltage having a prescribed waveform and applying the drive voltage to each of the recording elements through the at least one of the output elements selected in the output element selection step.

According to the present invention, since at least one drive circuit unit is selected from the plurality of drive circuit units provided in the output circuit block, in accordance with the recording data, in such a manner that the on-resistance value of the output circuit block is equal to or less than the prescribed value, then the waveform rounding of the drive voltage applied to the recording elements, which is caused by increase in the on-resistance of the drive circuit units, is improved, and the recording characteristics of the recording elements are stabilized.

Furthermore, since the drive circuit units are selected in accordance with the number of recording actions of the recording element as calculated from the recording data, then even if there is a temperature rise in the recording elements due to increase in the number of recording actions, waveform rounding of the drive voltage applied to the recording elements is suppressed and the recording characteristics of the recording elements are stabilized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 11 is a diagram showing the relationship between threshold values and the selection of drive circuit units;

DETAILED DESCRIPTION OF THE PREFERRED EMBODIMENTS

Figure 1:
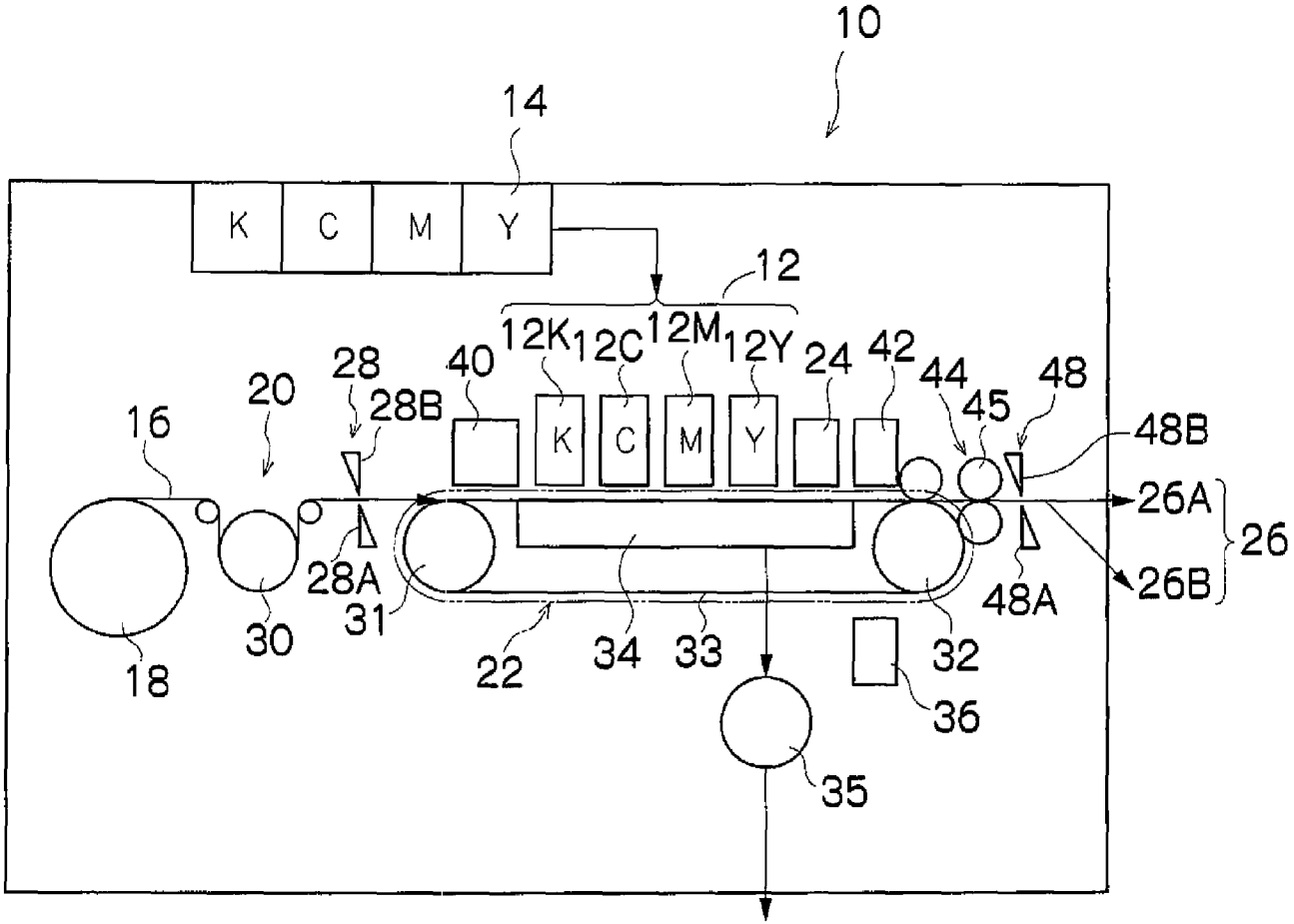
FIG. 1 is a general schematic drawing of an inkjet recording apparatus according to an embodiment of the present invention.

Firstly, a description is given about the overall composition of an inkjet recording apparatus as an embodiment of a liquid ejection apparatus according to the present invention. The inkjet recording apparatus is an image forming apparatus that forms a desired color image by means of colored inks ejected and deposited onto a recording medium. FIG. 1 is a diagram of the general composition of an inkjet recording apparatus according to an embodiment of the present invention.

As shown in FIG. 1, the inkjet recording apparatus 10 includes: a print unit 12 having a plurality of inkjet heads (hereafter, called "heads") 12K, 12C, 12M, and 12Y provided for colored inks of black (K), cyan (C), magenta (M), and yellow (Y), respectively; an ink storing and loading unit 14 for storing the inks of K, C, M and Y to be supplied to the heads 12K, 12C, 12M, and 12Y; a paper supply unit 18 for supplying recording paper 16, which is a recording medium; a decurling unit 20 removing curl in the recording paper 16; a suction belt conveyance unit 22 disposed facing the ink ejection faces (nozzle forming surfaces) of the heads 12K, 12C, 12M, and 12Y, for conveying the recording paper 16 while keeping the recording paper 16 flat; and a paper output unit 26 for outputting image-printed recording paper (printed matter) to the exterior.

The ink storing and loading unit 14 has ink supply tanks for storing the inks of K, C, M and Y to be supplied to the heads 12K, 12C, 12M, and 12Y, and the ink supply tanks are respectively connected to the heads 12K, 12C, 12M, and 12Y by means of prescribed ink flow channels 15.

The ink storing and loading unit 14 has a warning device (for example, a display device or an alarm sound generator) for warning when the remaining amount of any ink is low, and has a mechanism for preventing loading errors among the colors. The details of the ink supply system including the ink storing and loading unit 14 shown in FIG. 1 are described later.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink droplet ejection is controlled so that the ink droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, and shown in FIG. 6) being transmitted to at least one of the rollers 31 and 32, which the belt 33 is set around, and the recording paper 16 held on the belt 33 is conveyed from left to right in FIG. 1.

Since the ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration of nipping with a brush roller and a water absorbent roller, or an air blow configuration in which clean air is blown, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus can have a roller nip conveyance mechanism, in place of the suction belt conveyance unit 22. However, there is a drawback in the roller nip conveyance mechanism that the print tends to be blurred when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
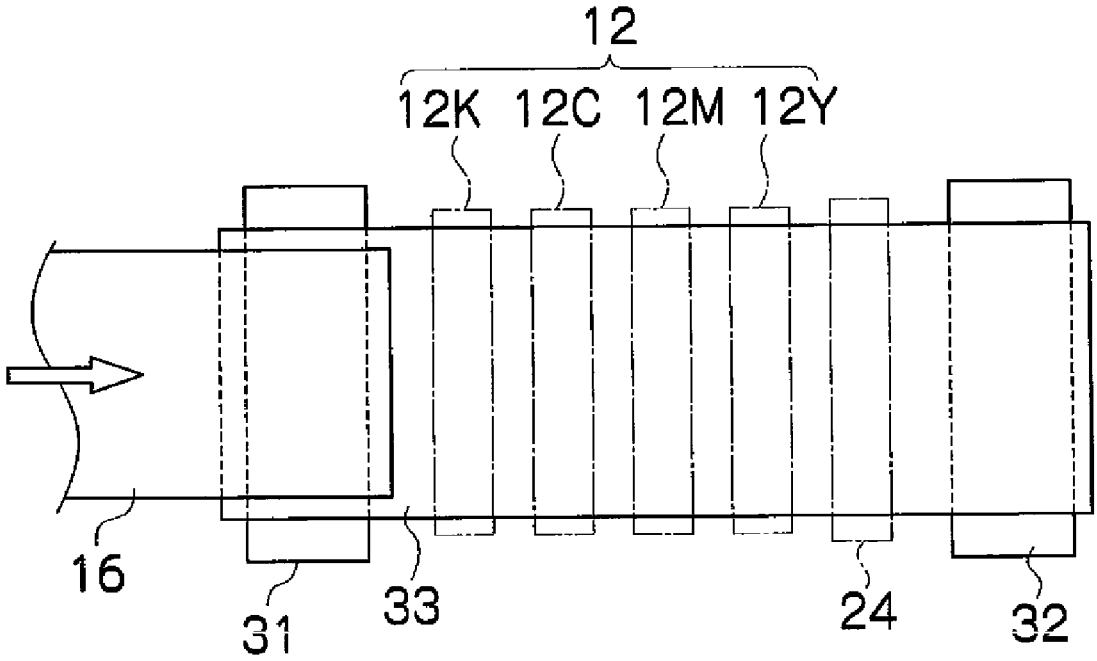
FIG. 2 is a principal plan diagram of the peripheral area of a print unit in the inkjet recording apparatus shown in FIG. 1.

The heads 12K, 12C, 12M and 12Y of the print unit 12 are full line heads having a length corresponding to the maximum width of the recording paper 16 used with the inkjet recording apparatus 10, and having a plurality of nozzles for ejecting ink arranged on a nozzle face through a length exceeding at least one edge of the maximum-size recording medium (namely, the full width of the printable range) (see FIG. 2).

The heads 12K, 12C, 12M and 12Y are arranged in color order (black (K), cyan (C), magenta (M), yellow (Y)) from the upstream side in the feed direction of the recording paper 16, and the heads 12K, 12C, 12M and 12Y are fixed extending (hereinafter, called the "paper conveyance direction") to the conveyance direction of the recording paper 16.

A color image can be formed on the recording paper 16 by ejecting and depositing inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged. In an inkjet recording apparatus based on a two-liquid system in which treatment liquid and ink are deposited on the recording paper 16, and the ink coloring material is caused to aggregate or become insoluble on the recording paper 16, thereby separating the ink solvent and the ink coloring material on the recording paper 16, it is possible to provide an inkjet head as a device for depositing the treatment liquid onto the recording paper 16.

The print determination unit 24 has an image sensor for capturing an image of the ink-droplet deposition result of the print unit 12, and functions as a device to check for ejection abnormalities such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) row of photoreceptor element composed of photoelectric transducing elements (pixels) arranged in a line provided with an R filter, a green (G) row of photoreceptor element with a G filter, and a blue (B) row of photoreceptor element with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head 12K, 12C, 12M, and 12Y is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

When the recording paper 16 is pressed by the heating/pressurizing unit 44, in cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of the head is described. The heads 12K, 12C, 12M and 12Y for the respective colored inks have the same structure, and a reference numeral 50 is hereinafter designated to any of the heads.

Figure 3A:
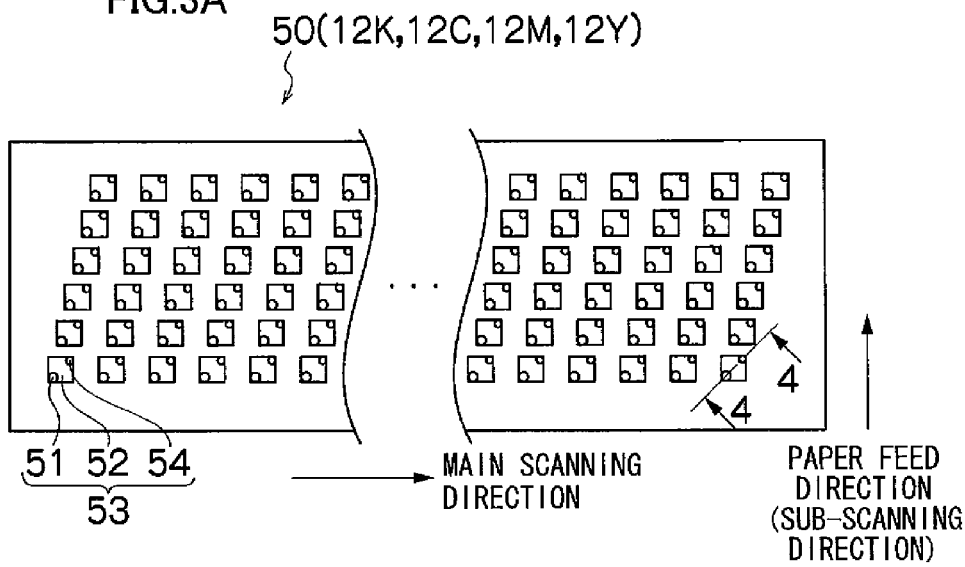
FIGS. 3A to 3C are plan view perspective diagrams showing examples of the composition of a print head.
Figure 3B:
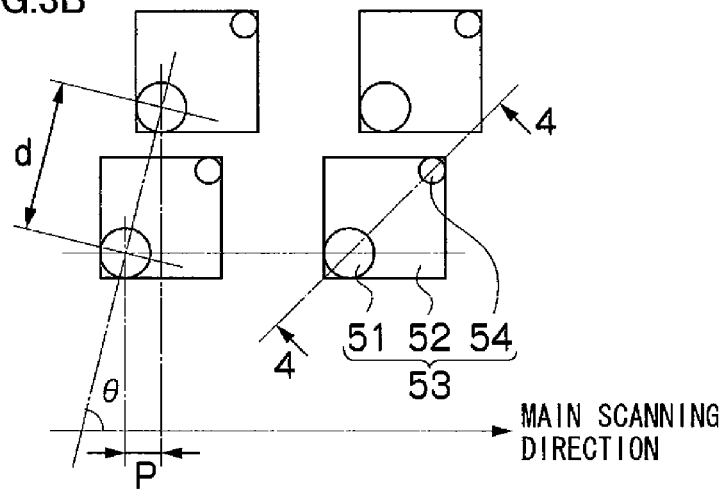
Figure 3C:
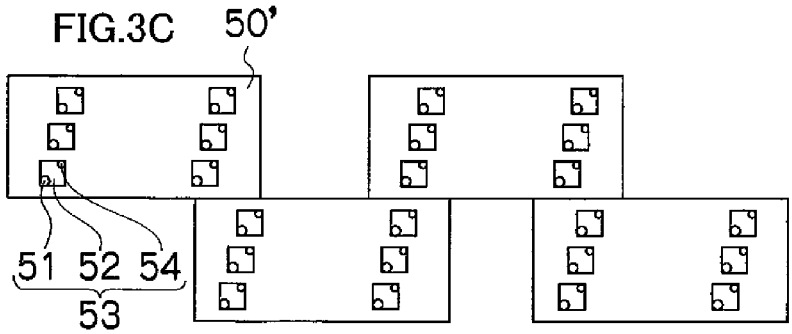
Figure 4:
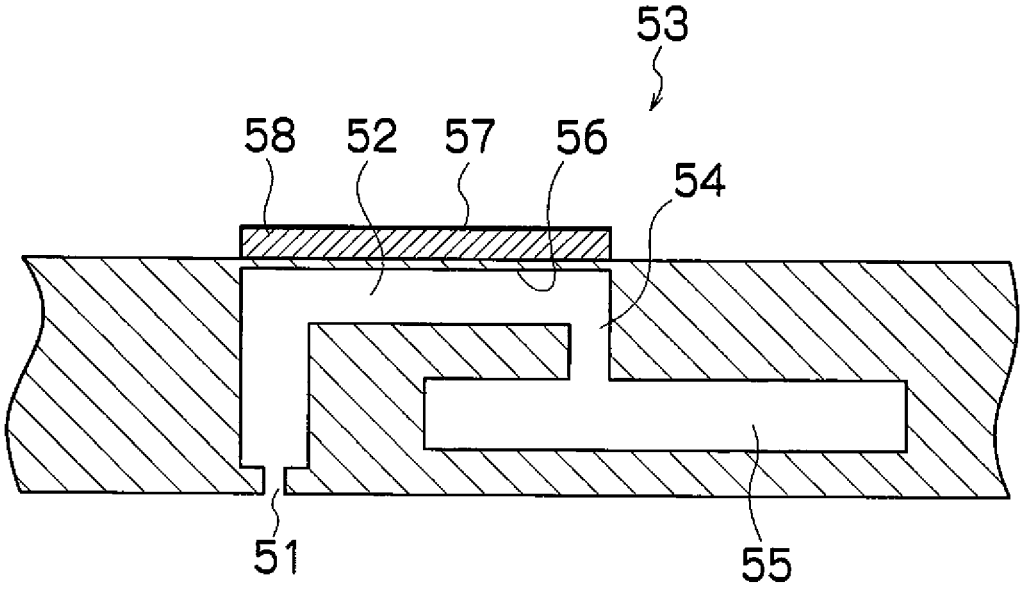
FIG. 4 is a cross-sectional diagram along line 4-4 in FIGS. 3A and 3B.

FIG. 3A is a perspective plan view showing an embodiment of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of a droplet ejection element (an ink chamber unit).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the embodiment described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion. Furthermore, although not shown in the drawings, it is also possible to compose a line head by arranging short heads in one row.

The planar shape of the pressure chamber 52 provided for each nozzle 51 is substantially a square, and the nozzle 51 and supplied ink 54 are disposed in both corners on a diagonal line of the square. Each pressure chamber 52 is connected to a common channel 55 through the supply port 54. The common channel 55 is connected to an ink supply tank 60 (not shown in FIG. 4, and shown in FIG. 5), which is a base tank that supplies ink, and the ink supplied from the ink supply tank is delivered through the common flow channel 55 in FIG. 4 to the pressure chambers 52.

A piezoelectric element 58 provided with an individual electrode 57 is bonded to a diaphragm 56, which forms the upper face of the pressure chamber 52 and also serves as a common electrode, and the piezoelectric element 58 is deformed when a drive voltage is supplied to the individual electrode 57, thereby causing the ink to be ejected from the nozzle 51. When ink is ejected, new ink is supplied to the pressure chamber 52 from the common flow passage 55, via the supply port 54.

The present embodiment is described with respect to the ink ejection method where the ink inside the pressure chamber is pressurized by the deformation of the piezoelectric element 58, but it is also possible to employ a thermal method in which pressure is applied to the ink inside a pressure chamber due to a film boiling action caused by operating a heat generating element provided inside the pressure chamber.

As shown in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to the printing system based on the line type of head, and it is also possible to adopt a serial system where a short head which is shorter than the breadthways dimension of the recording paper 16 is moved in the breadthways direction of the recording paper 16, thereby performing printing in the breadthways direction, and when one printing action in the breadthways direction has been completed, the recording paper 16 is moved through a prescribed amount in the direction perpendicular to the breadthways direction, printing in the breadthways direction of the recording paper 16 is carried out in the next printing region, and by repeating this sequence, printing is performed over the whole surface of the printing region of the recording paper 16.

Configuration of Ink Supply System

Figure 5:
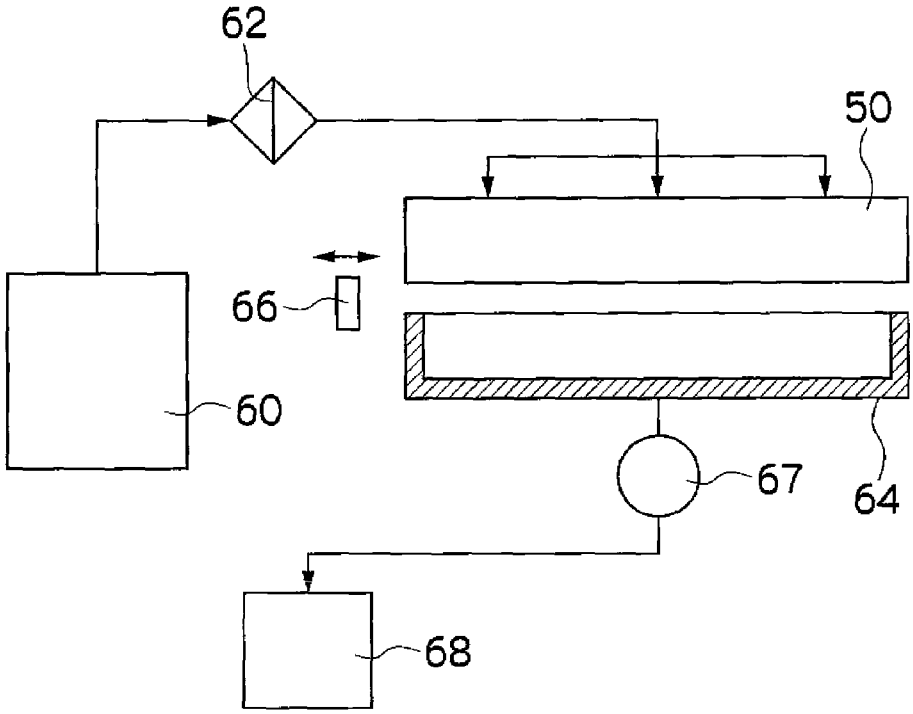
FIG. 5 is a conceptual diagram showing the composition of an ink supply system of the inkjet recording apparatus shown in FIG. 1.

FIG. 5 is a schematic drawing showing the configuration of the ink supply system in the inkjet recording apparatus 10. The ink supply tank 60 is a base tank that supplies the ink to the head 50 and is included in the ink storing and loading unit 14 described with reference to FIG. 1. The aspects of the ink supply tank 60 include a refillable type and a cartridge type; when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as shown in FIG. 5. The filter mesh size in the filter 62 is preferably equivalent to or less than the diameter of the nozzle and commonly about 20 μm.

Although not shown in FIG. 5, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 51, even if the piezoelectric element 58 is operated.

Therefore, before a situation of this kind develops (namely, while the ink is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

Furthermore, if bubbles enter into the ink inside the head 50 (inside the pressure chamber 52), then even if the piezoelectric element 58 is operated, it will not be possible to eject ink from the nozzle. In a case of this kind, the cap 64 is placed on the head 50, the ink (ink containing bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface (surface of the nozzle plate) of the head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade.

Description of Control System

Figure 6:
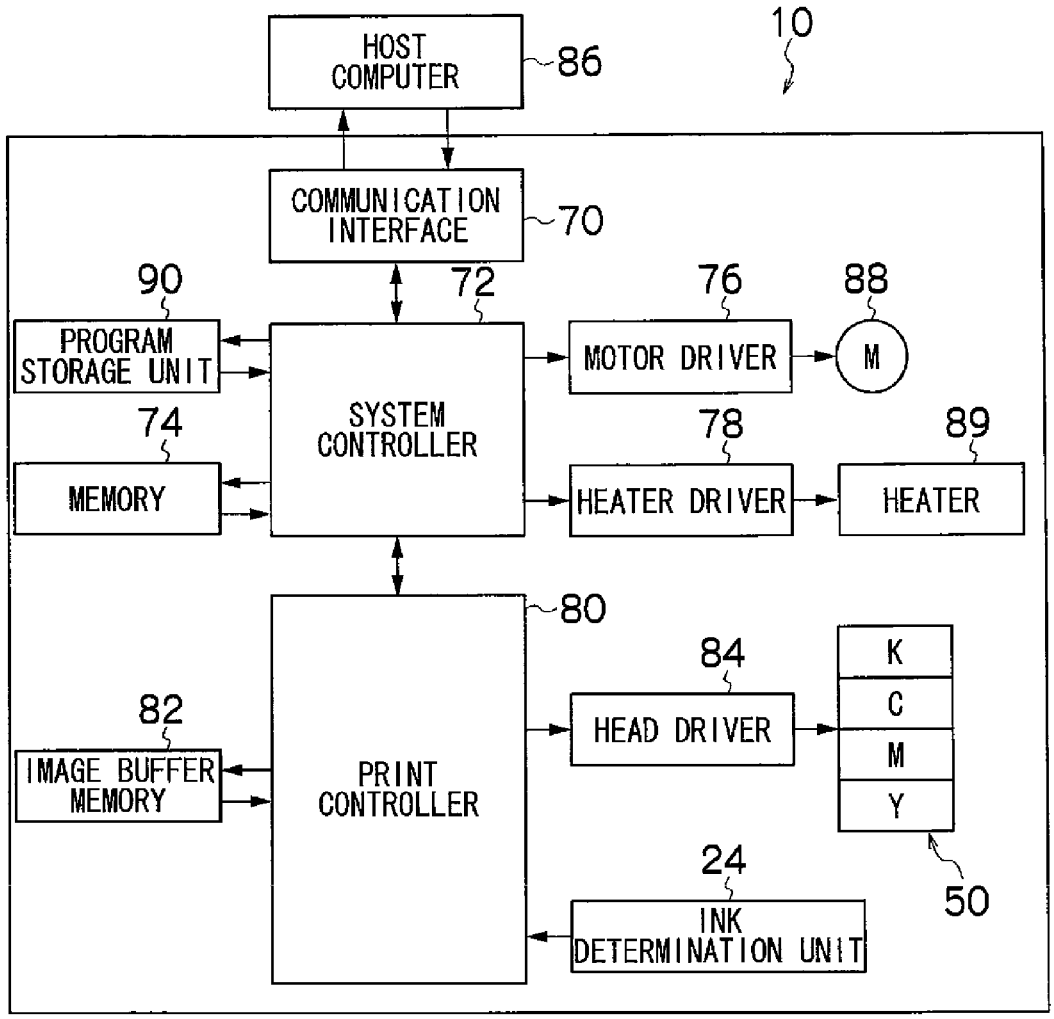
FIG. 6 is a conceptual diagram showing the composition of a control system of the inkjet recording apparatus shown in FIG. 1.

FIG. 6 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuit thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. In FIG. 6, the motors (actuators) disposed in the respective sections of the apparatus are represented by the reference numeral 88. For example, the motor 88 shown in FIG. 6 includes the motor that drives the drum 31 (32) in FIG. 1, a motor of the movement mechanism that moves the cap 64 in FIG. 5, a motor of the movement mechanism that moves the cleaning blade 66 in FIG. 5, and the like.

The heater driver 78 is a driver which drives heaters 89, including a heater forming a heat source of the heating fan 40 shown in FIG. 1, a heater of the post drying unit 42, and the like, in accordance with instructions from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 generates drive voltages to be applied to the piezoelectric elements 58 of the head 50, on the basis of image data supplied from the print controller 80, and includes a driving device block 100 (not shown in FIG. 6, and shown in FIG. 7), which drives the piezoelectric elements 58 by applying the generated drive voltages to the piezoelectric elements 58.

In the present embodiment, a common waveform method is employed for controlling ejection from the head (controlling the driving of the piezoelectric elements 58 shown in FIG. 4). In the common waveform method, a drive voltage is applied selectively from a common driving circuit to the plurality of piezoelectric elements, and it is performed to turn on and off switching elements provided in the drive voltage input section of each of the piezoelectric elements 58 (the switching elements forming a single function block constituted of the three drive circuit units 114, 116 and 118 in FIG. 7), in synchronism with the ejection timing, in such a manner that at least one waveform element corresponding to the image data is selected from the plurality of waveform elements corresponding to different ejection volumes, and is applied to each of the piezoelectric elements 58. The drive voltage can be composed by appropriately assembling a plurality of waveform elements, in order to achieve a prescribed ink ejection volume in each ejection operation. A feedback control system for maintaining constant drive conditions in the head may be included in the head driver 84 shown in FIG. 6.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 or carries out the maintenance of the head 50 on the basis of information obtained from the print determination unit 24.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color, in the print controller 80. In other words, the print controller 80 performs processing for converting the inputted RGB image data into dot data for the four colors, K, C, M and Y. The dot data generated by the print controller 80 is stored in the image buffer memory 82.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided. The program storage section 90 may also be combined with a storage device for storing operational parameters, and the like (not shown).

Description of Driving Device

Next, the driving device of the head according to the present embodiment is described in detail. The driving device 100 shown in FIG. 7 is included in the head driver 84 shown in FIG. 6.

Figure 7:
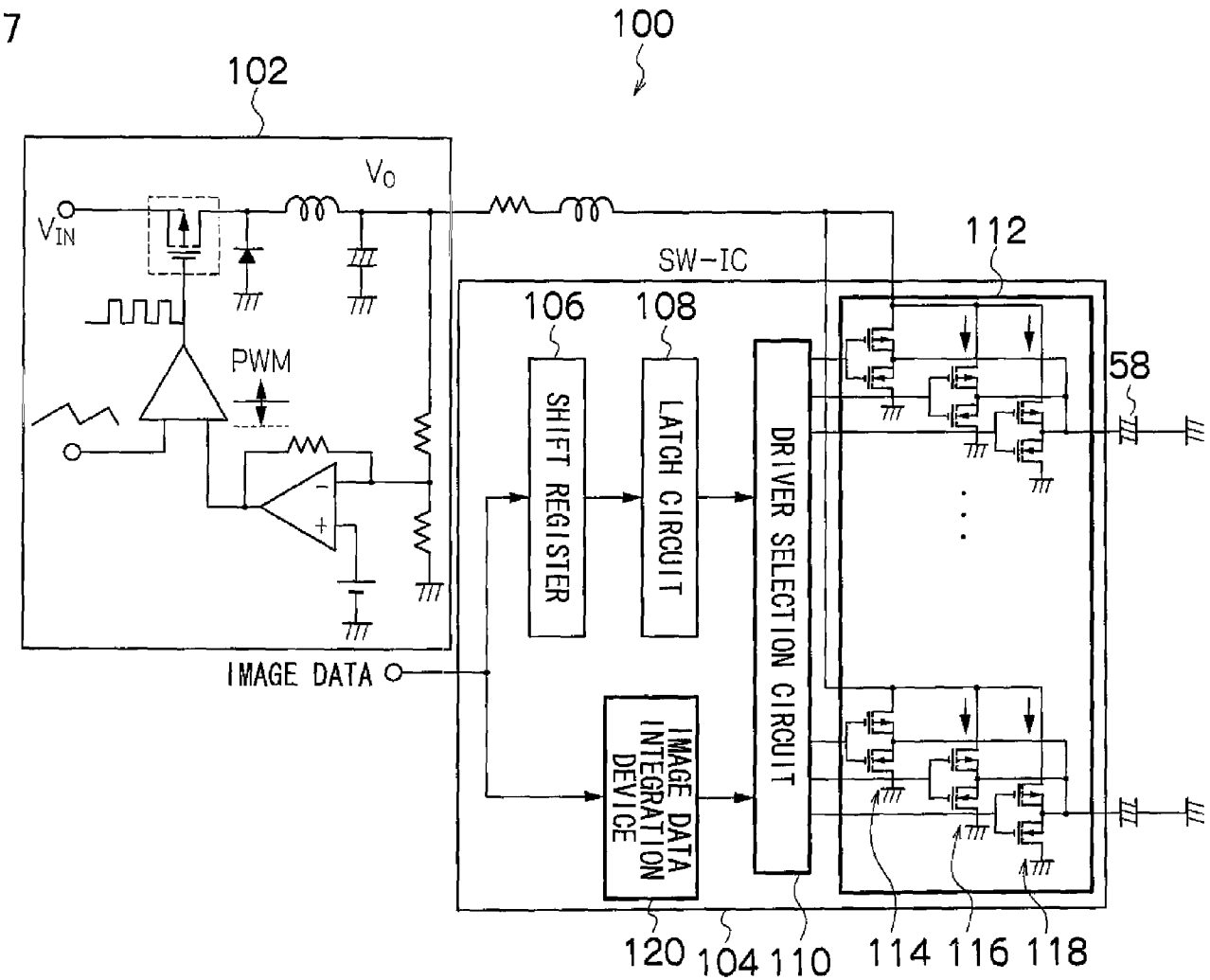
FIG. 7 is a block diagram showing the composition of the driving device of the piezoelectric elements according to an embodiment of the present invention.
Figure 14:
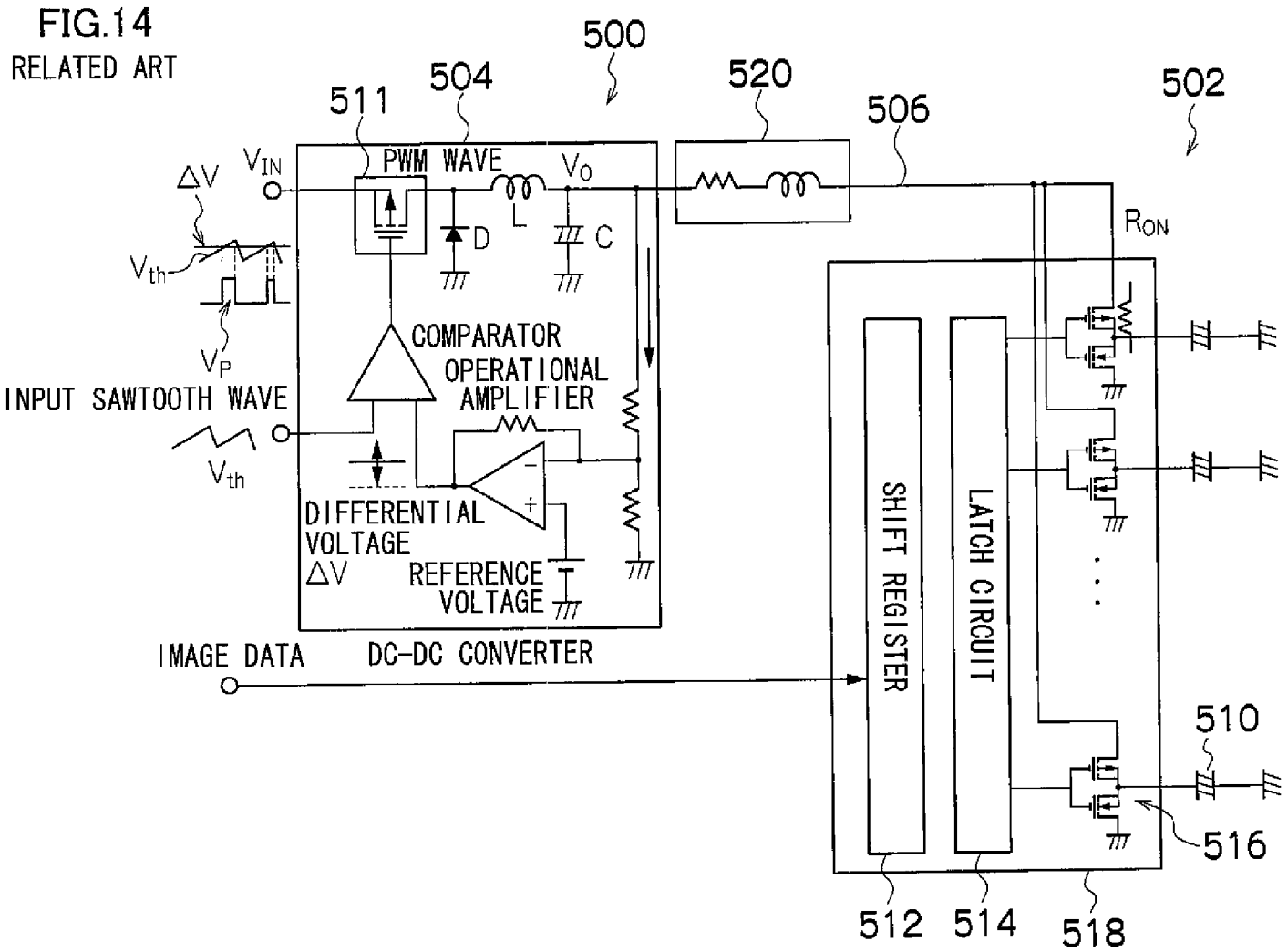
FIG.14 RELATED ART
FIG. 14 is a block diagram showing the composition of a driving device of piezoelectric elements according to the related art.
Figure 15A:
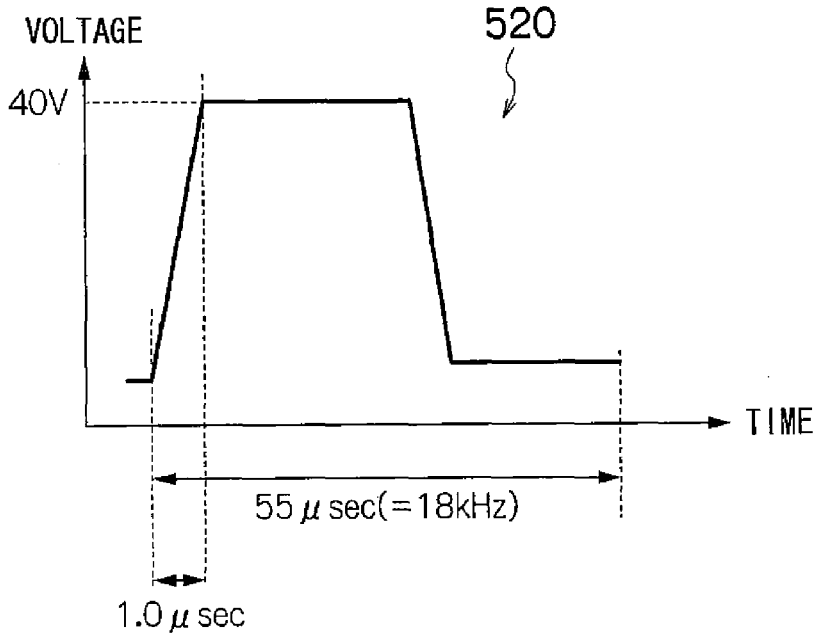
FIG.15A RELATED ART
FIGS. 15A and 15B are diagrams illustrating the waveform distortion in the drive voltage.
Figure 15B:
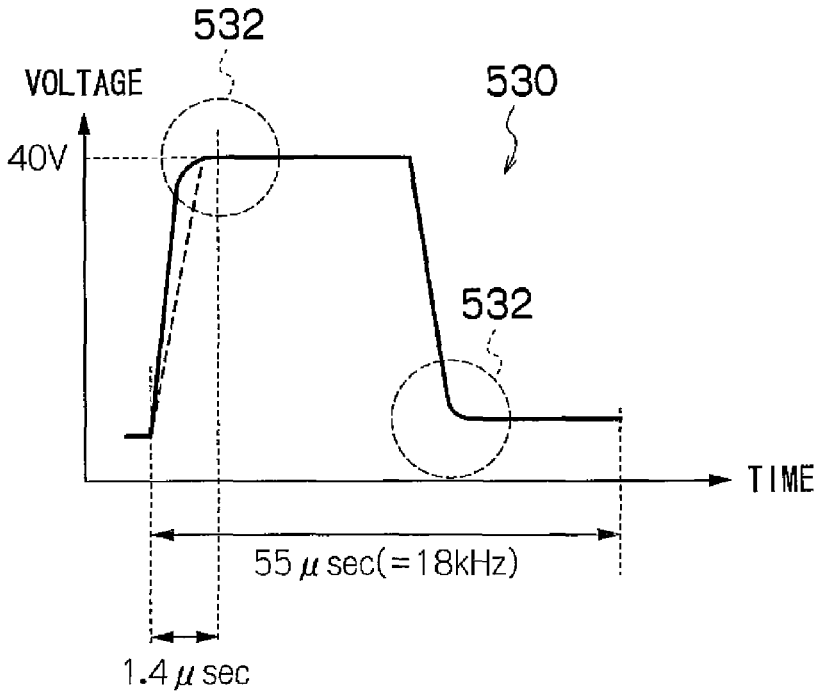
FIG.15B RELATED ART
Figure 16:
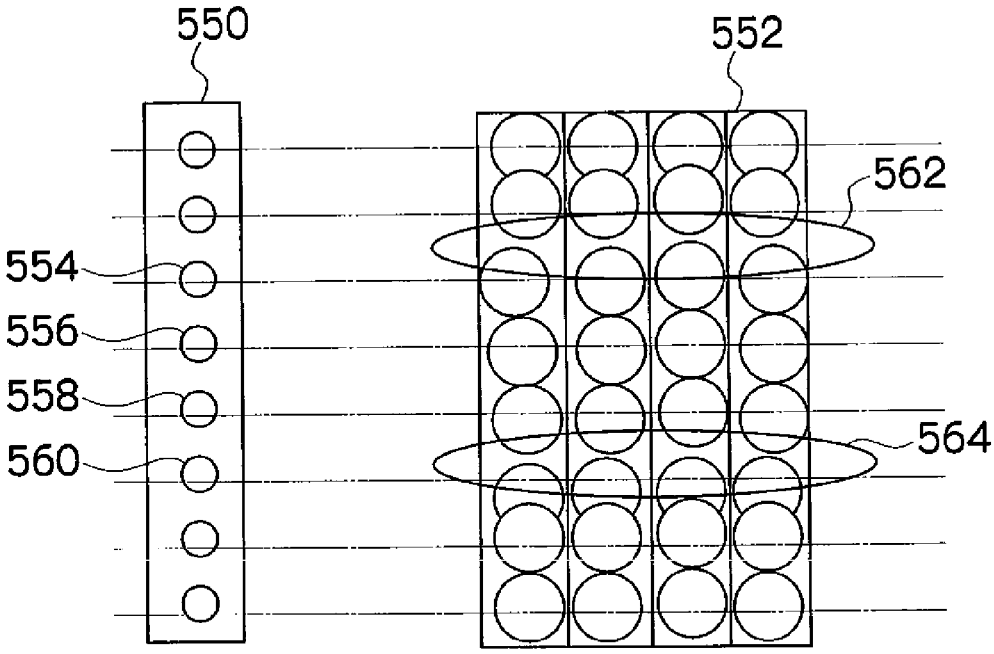
FIG.16 RELATED ART
FIG. 16 is a diagram illustrating recording abnormalities caused by temperature rise in the central portion of the head according to the related art.
Figure 17:
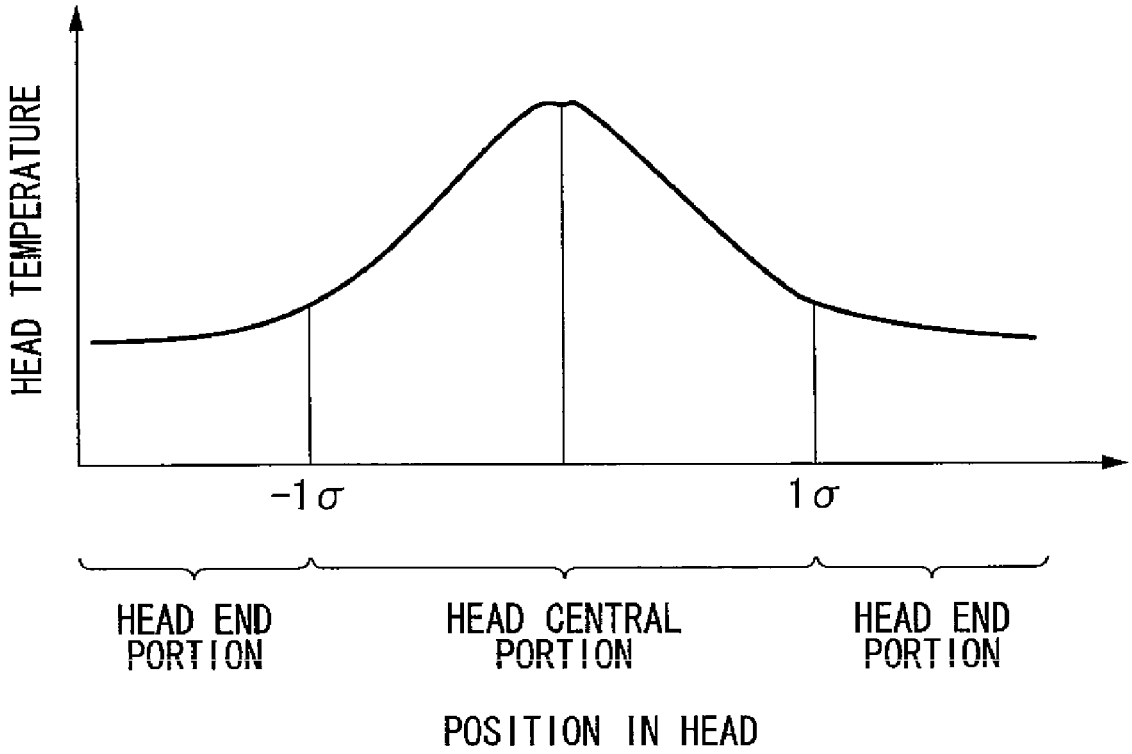
FIG.17 RELATED ART
FIG. 17 is a diagram illustrating the temperature distribution in a head according to the related art.

As shown in FIG. 7, the driving device 100 includes a DC-DC converter 102 and a switch IC (SW-IC) 104. The DC-DC converter 102 has the same composition as the DC-DC converter 504 shown in FIG. 14, and therefore farther description thereof is omitted here. When image data (information in digital format that has been converted from ROB pixel data to KMCY dot data) is received from the print controller 80 shown in FIG. 6, the dot data is converted into waveform data and stored temporarily in the shift register 106, whereupon the data is sent to an output circuit (drive stage) 112 via a drive selection circuit 110, in synchronism with a prescribed clock (not shown).

The output circuit 112 shown in the present embodiment has three drive circuit units 114, 116 and 118 for each of the piezoelectric elements 58, and is composed in such a manner that the three drive circuit units 114, 116 and 118 can be selected appropriately in accordance with the information in the image data. It is suitable to use push-pull circuit for the drive circuit units shown in FIG. 7. Of course, it is also possible to use another circuit composition.

The output circuit 112 shown in FIG. 7 has a structure in which the three drive circuit units 114, 116 and 118 having the same on-resistance values are connected in parallel, and by successively increasing the number of drive circuit units selected on the basis of the information in the image data, from one to three circuit units, the on-resistance acting on the one piezoelectric element 58 is reduced, and the waveform rounding in the drive voltage applied to the piezoelectric element 58 is thereby improved. For example, if the two drive circuit units 114 and 116 are selected and activated, and a drive voltage is applied to the piezoelectric element 58 through these two drive circuit units, then the on-resistance acting on the piezoelectric element 58 is equivalent to the combined on-resistance of the two drive circuit units connected in parallel, and provided that the on-resistance values of the two drive circuit units 114 and 116 are the same, the on-resistance becomes one half of the value obtained if only one of the drive circuit units is used.

Similarly, if all the three drive circuit units 114, 116 and 118 are selected and activated, then provided that these three drive circuit units have the same on-resistance values, the on-resistance acting on the piezoelectric element 58 becomes one third of the value obtained if only one circuit unit is selected.

Reference here to "the same on-resistance value" includes resistance values that include error arising during manufacture, or tolerable errors in the drive circuit units. Desirably, the "same on-resistance value" contains an error of no more than 5%, and more desirably, no more than 1%.

An image data integration device 120 shown in FIG. 7 is a calculation function block that calculates the integrated value of the number of ejection actions (number of recording actions; number of dots) for the respective ejection timings of the respective piezoelectric elements 58, from the image data supplied by the print controller 80 shown in FIG. 6.

The image data integration device has a memory (not shown) that temporarily stores the integrated value of the number of ejection actions calculated for the piezoelectric elements 58; the integrated value calculated for each ejection timing is stored temporarily in this memory and when the next integrated value is calculated, the data in the memory is rewritten accordingly with the next value.

More specifically, in the driving device 100 shown in the present embodiment, when the integrated value of the number of ejection actions increases during the course of image recording, the drive selection circuit 110 selects at least one drive circuit unit from the plurality of drive circuit units in order to increase the number of drive circuit units that apply a drive voltage to each of the piezoelectric elements 58, and the on-resistance value acting on each piezoelectric element 58 is reduced in the plurality of drive circuit units (output circuit 112) that function as a single drive circuit unit.

Figure 8:
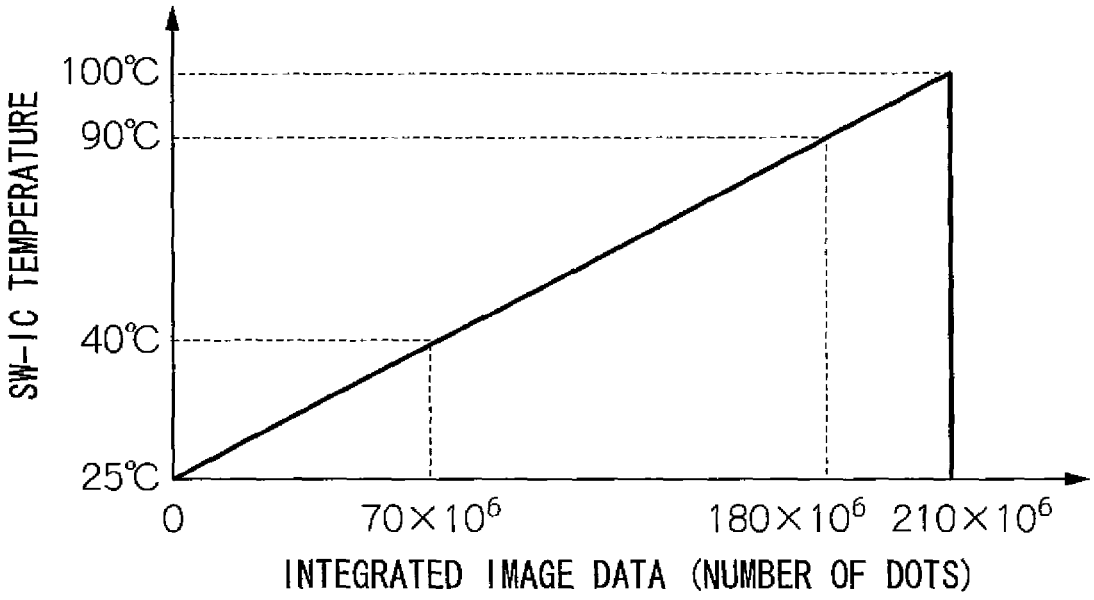
FIG. 8 is a graph showing the correlation between the integrated image data and the temperature of the switch IC.

Next, a concrete example of the switching of drive circuit units in the driving device 100 shown in the present embodiment is described. Here, it is assumed that the correlation shown in FIG. 8 between the image data (number of dots) and the temperature (° C.) of the switch IC, and the correlation shown in FIG. 9 between the temperature (° C.) of the switch IC 104 and the on-resistance (Ω) of the drive circuit unit, are already known. In FIG. 8, the temperature of the switch IC 104 (see FIG. 7) at the start of image recording is taken to be 25° C. (normal temperature).

Furthermore, the conditions for image recording are as follows:

Nozzle density in the head: 600 (npi (nozzles per inch));

Size of the recording media: A4;

Conveyance speed of the recording media: 90 (sheets per minute);

Print duty: 30%;

Duration per job: 30 minutes; and

Temperature rise in the apparatus: 40° C.

From the conditions described above, the number of dots per recording medium is calculated to be 80,000 dots, and the total number of dots per job is calculated to be $210\times10^6$ dots.

As shown in FIG. 8, the temperature (surface temperature) of the switch IC 104 is directly proportional to the integrated image data, and if the temperature at the start of image recording is 25° C., then the temperature at the end of image recording under the above-described conditions reaches 100° C. For example, the temperature of the switch IC 104 is 40° C. when the integrated image data is $70\times10^6$ dots, and the temperature of the switch IC 104 is 90° C. when the integrated image data is $180\times10^6$ dots.

If the temperature of the switch IC 104 changes from 25° C. to 100° C. in this way, then the on-resistance of the drive circuit unit increases from 1.0 kΩ to 8.0 kΩ. For example, if the temperature of the switch IC 104 is 40° C. (when the integrated image data is $70\times10^6$ dots), then the on-resistance becomes 2.2 kΩ, and if the temperature of the switch IC 104 is 90° C. (when the integrated image data is $180\times10^6$ dots), then the on-resistance becomes 6.8 kΩ.

In the switch IC 104 having the above-described characteristics, if threshold values are set for the integrated image data in such a manner that the on-resistance value acting on each piezoelectric element 58 (the combined on-resistance value if a plurality of drive circuit units have been selected) does not exceed a resistance value of 2.2 kΩ, which avoids affecting the ejection speed, then the first threshold value is set to $70\times10^6$ dots, the second threshold value is set to $180\times10^6$ dots, and one or a plurality of drive circuit units are selected from the drive circuit units 114 to 118 show in FIG. 7, on the basis of these two threshold values.

Figure 10:
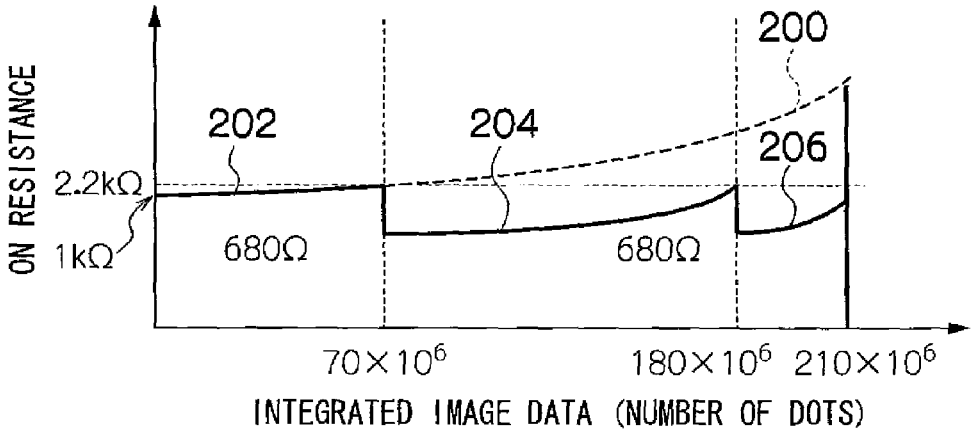
FIG. 10 is an illustrative diagram of the control of drive circuit unit selection switching.

FIG. 10 shows the relationship between the integrated image data and the on-resistance of the drive circuit units (combined on-resistance). As shown in FIG. 10, when the integrated image data is not more than the first threshold value ($70\times10^6$ dots), then only one drive circuit unit is selected in the output circuit 112 shown in FIG. 7. Here, the drive circuit unit 114 is selected, and the drive circuit unit 114 is activated. As the image recording progresses, the on-resistance of the one drive circuit unit increases as in a curve 202 in FIG. 10.

As the image recording progresses and the value of the integrated image data exceeds the first threshold value, then two drive circuit units are selected in the output circuit 112 shown in FIG. 7. Here, the drive circuit unit 116 is selected in addition to the drive circuit unit 114, and hence the drive circuit unit 116 is activated in addition to the drive circuit unit 114. The combined on-resistance of the on-resistance of the drive circuit unit 114 (2.2 kΩ) and the on-resistance (1.0 kΩ) of the newly selected drive circuit unit 116 is 680Ω, and therefore waveform rounding of the drive voltage arising from variation in the on-resistance is suppressed, and decline in the ejection speed of the ink droplets does not occur. As the image recording progresses, the combined on-resistance of the two drive circuit units increases as in a curve 204 in FIG. 10.

When the image recording progresses further and the value of the integrated image data exceeds the second threshold value ($180\times10^6$ dots), then in the output circuit 112 shown in FIG. 7, the drive circuit unit 118 is selected in addition to the drive circuit unit 114 and the drive circuit unit 116, and the drive circuit unit 118 is activated in addition to the drive circuit units 114 and 116. The combined on-resistance in this case is 680Ω, and therefore waveform rounding of the drive voltage caused by variation in the on-resistance is suppressed, and decline in the ejection speed of the ink droplets does not occur. As the image recording progresses, the combined on-resistance of the three drive circuit units increases as in a curve 206 in FIG. 10.

On the other hand, if the number of drive circuit units does not change in accordance with the integrated image data, as described above, (for example, if only the drive circuit unit 114 is selected, at all times), then as in a curve 200 depicted with a dashed line in FIG. 10, the on-resistance of the drive circuit unit increases as the image recording progresses, and therefore waveform rounding occurs in the drive voltage due to the variation in the on-resistance (see FIG. 155B), and therefore, decline in the ejection speed of the ink droplets occurs.

Since the image recording conditions set as presuppositions vary in accordance with the contents of the recorded image (image data) and the recording settings, then it is desirable that a plurality of sets of the first threshold value and the second threshold value are prepared in advance, and stored as a data table. FIG. 11 shows an embodiment of the structure of the data table. A desirable mode is one which has a plurality of data tables containing different sets of a first threshold value (threshold value 1) and a second threshold value (threshold value 2), in accordance with the contents of the image data.

In the present embodiment, the mode is described in which the three drive circuit units are switched selectively on the basis of the two threshold values, but the number of drive circuit units is not limited to three, and it is also possible to switch two drive circuit units selectively, or to switch four or more drive circuit units selectively. In a mode where "n" drive circuit units are provided, "n−1" threshold values are set. However, if the number of drive circuit units corresponding to each piezoelectric element 58 is increased, then the switch IC becomes larger in size, and therefore it is desirable that the number of drive circuit units corresponding to each piezoelectric element 58 is approximately three. Furthermore, in a line type head in which nozzles are arranged in a matrix configuration as shown in FIGS. 3A to 3C, provided that the on-resistance value of the output circuit 112 can be switched between three stages, then it is possible to maintain stable ejection characteristics under the image recording conditions that can be envisaged.

The driving device of the recording head having the above-described composition avoids variation in the ejection characteristics caused by increase in the on-resistance of the switch IC 104 as a result of increase in the temperature, and can therefore achieve stable ejection characteristics. Furthermore, since the output circuit has a structure in which a plurality of drive circuit units having the same on-resistance are connected in parallel, then the IC can be made easily in the manufacturing process.

Moreover, since the correlation between the integrated image data and the temperature of the switch IC 104 is determined in advance, the temperature of the switch IC 104 is deduced from the integrated image data (in other words, temperature information for the switch IC 104 is obtained indirectly from the integrated image data), and the number of drive circuit units to be used is determined on this basis, then the above-described driving device 100, which is required to have good response to temperature change since the waveform rounding in question has a short time of approximately several microseconds, displays better responsiveness to temperature change than a system using temperature measurement using a thermistor or other temperature sensor, and therefore a desirable output circuit can be achieved, and stable ejection characteristics are maintained.

In the present embodiment, the common drive waveform method is illustrated as the ejection control method, but the scope of the present invention is not limited to this. For example, in a drive method that applies individual drive waveforms (drive voltages) to the piezoelectric elements, a composition similar to the output circuit 112 shown in FIG. 7 (drive circuit units 114 to 118) is used widely in the drive circuit units of the piezoelectric elements, and therefore it is possible to apply the composition of the output circuit and the selective switching control of the drive circuit units described in the present embodiment.

Modification Embodiment

Next, an embodiment of a modification of the above-described drive circuit unit of the recording head is explained. In the present embodiment, a composition is adopted whereby if two or three drive circuit units are selected (in other words, when the integrated image data has exceeded the first threshold value and the drive circuit units of the second and subsequence stage have become active), then the on-resistance of the switch IC 104 shown in FIG. 7 does not exceed 1 kΩ.

Figure 12:
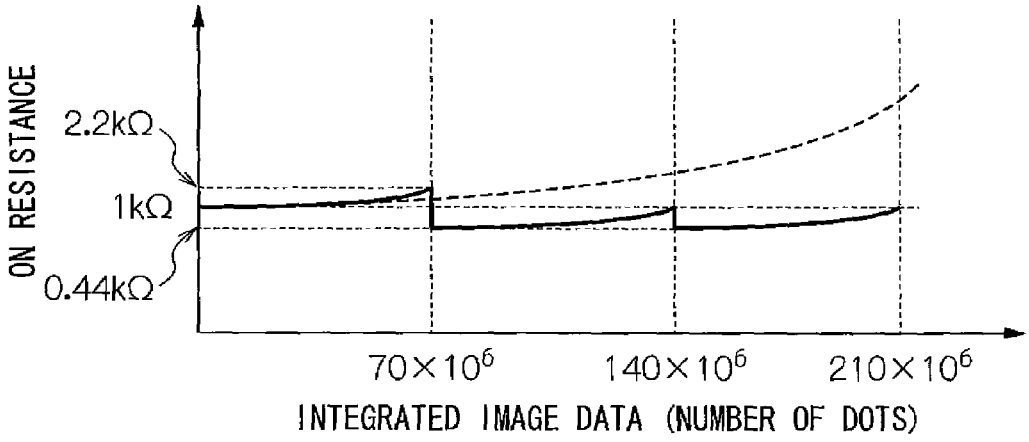
FIG. 12 is an illustrative diagram of the control of drive circuit unit selection switching according to a modification embodiment of the present invention.

FIG. 12 shows the relationship between the integrated image data and the on-resistance of the drive circuit units according to the present embodiment. In the present embodiment, the on-resistance of the drive circuit unit 114 shown in FIG. 7 is 1 kΩ, the on-resistance of the drive circuit unit 116 is 0.8 kΩ, the on-resistance of the drive circuit unit 118 is 0.8 kΩ, the first threshold value is $70\times10^6$ dots, and the second threshold value is $140\times10^6$ dots.

More specifically, if the integrated image data is 0 through $70\times10^6$ dots, then the drive circuit unit 114 alone is selected. When the integrated image data exceeds $70\times10^6$ dots and is not more than $140\times10^6$ dots, then the drive circuit unit 114 and the drive circuit unit 116 (or the drive circuit unit 118) are selected, and the combined on-resistance in this case is 0.44 kΩ. Moreover, when the integrated image data exceeds $140\times10^6$ dots and is not more than $210\times10^6$ dots, then all of the drive circuit units 114 to 118 are selected, and the combined on-resistance value in this case is 0.44 kΩ.

According to the present embodiment, if two or more drive circuit units are switched on, then the on-resistance of the output circuit 112 is prevented from exceeding the initial value, and the ejection characteristics can therefore be stabilized.

Next, another embodiment of the present invention is explained. In the present embodiment, a temperature sensor is provided to determine the ambient temperature of the apparatus in which the drive circuit unit 100 is mounted (the external temperature of the apparatus), and the first threshold value and the second threshold value described above are offset on the basis of the temperature information obtained from the temperature sensor.

In other words, if the temperature at the start of a job is 30° C., then the first threshold value and the second threshold value are each reduced with respect to the reference temperature of 25° C., by an amount corresponding to $27\times10^6$ dots, which is equivalent to 5° C., and hence the threshold values are shifted toward the left-hand side in FIG. 12. Furthermore, the temperature is determined at prescribed sampling timings (for example, a frequency of two or more times the ejection frequency), and the threshold values are corrected accordingly in real time.

A thermistor that is compact and has good temperature tracking characteristics is suitable for use as the temperature sensor in the present embodiment. Of course, it is also possible to use another type of temperature sensor, provided that it can be disposed on the drive circuit unit or in the periphery of the drive circuit unit and has good accuracy and good temperature tracking characteristics.

Figure 13:
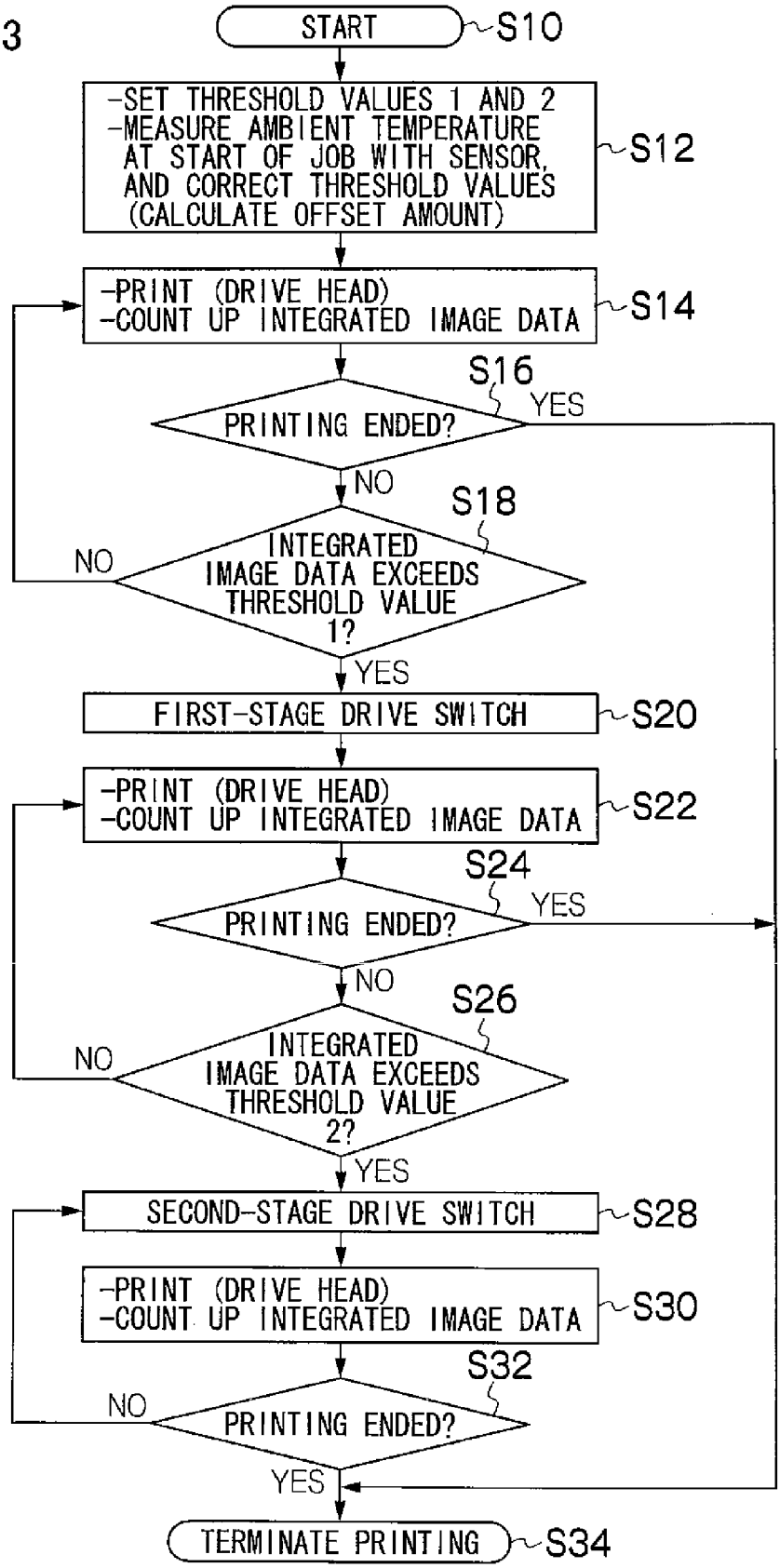
FIG. 13 is a flow chart of the control of drive circuit unit selection switching according to an embodiment of the present invention.

FIG. 13 is a flowchart of a drive circuit unit selection control procedure according to the present embodiment. As shown in FIG. 13, when an image recording job starts (step S10), a prescribed initialization process is carried out, and furthermore, image data is acquired and various initial settings are made (Step S12).

Figure 9:
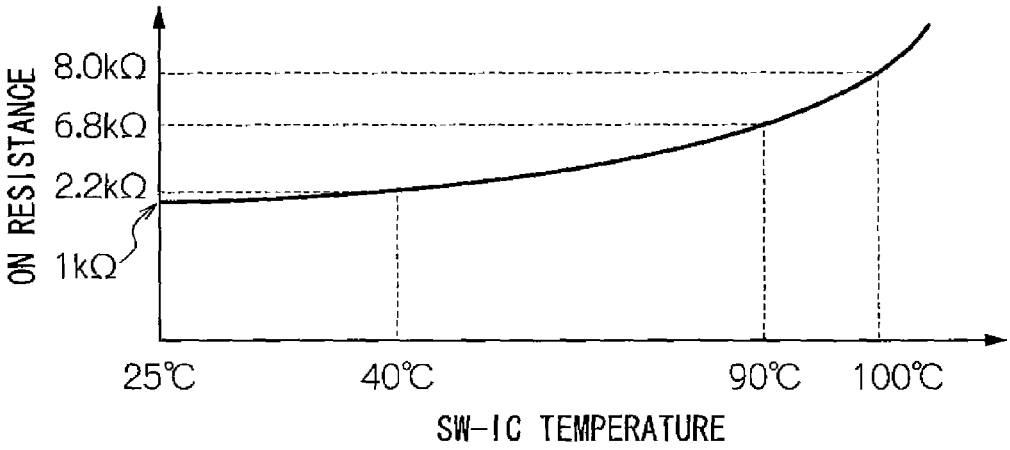
FIG. 9 is a graph showing the correlation between the switch IC temperature and the on-resistance of the drive circuit unit.

To give a concrete description of the procedures shown in step S12, the counter which counts the integrated image data is reset, temperature information is acquired from a temperature sensor that determines the ambient temperature of the driving device 100, the measured temperature is set to the temperature for the start of the print job, and the first threshold value (threshold value 1) and the second threshold value (threshold value 2) shown in FIG. 9 and FIGS. 12 and 13 are set on the basis of the acquired image data and the temperature at the start of the job. Furthermore, only one drive circuit unit of the output circuit 112 (for example, the drive circuit unit 114) is selected by the drive selection circuit 110 in FIG. 7.

If the first threshold value and the second threshold value are set by carrying out the procedure in step S12, then image recording (printing, head driving) is started, and counting of the integrated image data is started (step S14). During the image recording, the state of progress of the image recording is monitored (step S16), and if it is judged at step S16 that the image recording has ended (YES verdict), then the procedure advances to step S34 and the image recording terminates.

If, on the other hand, it is judged at step S16 that the image recording is still in progress (NO verdict), then the integrated image data is compared with the first threshold value (step S18), and if the integrated image data is not more than the first threshold value (NO verdict), then the image recording and the counting of the integrated image data are continued (step S14).

At step S18, if the integrated image data exceeds the first threshold value (YES verdict), then a drive circuit unit selection change is requested of the drive selection circuit 110 shown in FIG. 7, and the drive selection circuit 110 changes the drive circuit unit selection in such a manner that the drive circuit unit 114 is selected in addition to the drive circuit unit 112 (first-stage drive switching, step S20 in FIG. 13).

After the two drive circuit units have been selected in the first drive circuit unit switching step shown in step S20, the image recording (printing) and the counting of the integrated image data are continued (step S22), the state of progress of the image recording is monitored during the image recording operation (step S24), and if it is judged at step S24 that the image recording has ended (YES verdict), then the procedure advances to step S34 and the image recording is terminated.

If, on the other hand, it is judged at step S24 that the image recording is still in progress (NO verdict), then the integrated image data is compared with the second threshold value (step S26), and if the integrated image data is not more than the second threshold value (NO verdict), then the image recording and the counting of the integrated image data are continued (step S22).

At step S24, if the integrated image data exceeds the second threshold value (YES verdict), then a drive circuit unit selection change is requested of the drive selection circuit 110 shown in FIG. 7, and the drive selection circuit 110 changes the drive circuit unit selection in such a manner that the drive circuit unit 116 is selected in addition to the drive circuit unit 112 and the drive circuit unit 114 (second-stage drive switching, step S28 in FIG. 13).

After the three drive circuit units have been selected in the second drive circuit unit switching step shown in step S28, the image recording (printing) and the counting of the integrated image data are continued (step S30), the state of progress of the image recording is monitored during the image recording operation (step S32), and if it is judged at step S32 that the image recording has ended (YES verdict), then the procedure advances to step S34 and the image recording is terminated.

If, on the other hand, it is judged at step S30 that image recording is still in progress (NO verdict), then the image recording and the counting of the integrated image data are continued (step S30).

According to the present embodiment, the ambient temperature of the driving device 100 shown in FIG. 7 is measured, and the threshold values of the integrated image data are offset on the basis of the ambient temperature information. Thus, it is possible to suppress variation in the ejection characteristics caused by variation in the ambient temperature.

A desirable mode is one where the correlations between the ambient temperature, the first threshold value and the second threshold value are stored in advance in the form of a data table, and the first threshold value and the second threshold value are corrected (the first threshold value and the second threshold value are changed) by referring to the data table, on the basis of the determination result from the temperature sensor. The data table is stored in the memory 74 shown in FIG. 6, or in a special storage device.

In the present embodiment, the mode is shown in which the ambient temperature of the apparatus is determined at the start of image recording, and the first threshold value and the second threshold value are corrected on the basis of the determined ambient temperature, but a mode is also possible in which the ambient temperature of the apparatus during image recording is monitored periodically, and the first threshold value and the second threshold value are corrected at respective ambient temperature determination timings.

According to the present embodiment, by carrying out correction on the basis of ambient conditions, in respect of the temperature information for the switch IC 104 that is determined indirectly on the basis of the image information (integrated image data), it is possible to respond to ambient change during the operation of the apparatus and stable ejection characteristics (stable quality of the recorded image) are ensured, regardless of the ambient conditions.

In the above-described embodiments, the inkjet recording apparatus has been described as an example of the apparatus to which the present invention is applied, but the application of the present invention is not limited to this, and it may also be applied broadly to a liquid ejection apparatus including a liquid ejection head which ejects liquid, an image recording apparatus including a recording head which is equipped with recording elements, such as LEDs, and the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A driving device of a recording head having a recording element, the driving device comprising:

a driving circuit which drives a recording element; and a power supply device which supplies power to the driving circuit, wherein the driving circuit includes:

an output circuit block which is supplied with the power from the power supply device, and amplifies and converts an input signal having a prescribed voltage waveform corresponding to recording data into a drive voltage applied to the recording element, the output circuit block having a structure in which a plurality of drive circuit units are connected in parallel to the recording element and respectively have transistors of which output terminals are connected to the recording element;

a recording data integration device which determines an integrated value of a number of recording actions of the recording element according to the recording data; and a drive circuit unit selection device which selects at least one of the drive circuit units in accordance with the integrated value determined by the recording data integration device, in such a manner that an on-resistance value of the output circuit block which is a combined on-resistance of the transistors acting on the recording element is kept below a prescribed value.

2. The driving device as defined in claim 1, further comprising:

a threshold value setting device which sets a threshold value with respect to the integrated value in accordance with a correlation between the integrated value and a temperature change in the drive circuit units, wherein the drive circuit unit selection device compares the integrated value with the threshold value set by the threshold value setting device and selects only one of the drive circuit units in a case where the integrated value is not more than the threshold value, and selects at least two of the drive circuit units in a case where the integrated value exceeds the threshold value in such a manner that the on-resistance value of the output circuit block is kept below the on-resistance value of the output circuit block when the only one of the drive circuit units is selected.

3. The driving device as defined in claim 2, further comprising:

a temperature determination element which determines an ambient temperature; and a threshold value correction device which corrects the previously set threshold value to a smaller value, when the temperature determined by the temperature determination element is higher than a previously established reference temperature.

4. The driving device as defined in claim 1, wherein:

the output circuit block has the structure in which three of the drive circuit units are connected in parallel to the recording element;

the driving device further comprises a threshold value setting device which sets first and second threshold values with respect to the integrated value in accordance with a correlation between the integrated value and a temperature change in the drive circuit units, the second threshold value being larger than the first threshold value; and the drive circuit unit selection device compares the integrated value with the first and second threshold values set by the threshold value setting device and selects only one of the drive circuit units in a case where the integrated value is not more than the first threshold value, selects two of the drive circuit units in a case where the integrated value exceeds the first threshold value and is not more than the second threshold value in such a manner that the on-resistance value of the output circuit block is kept below the on-resistance value of the output circuit block when the only one of the drive circuit units is selected, and selects three of the drive circuit units in a case where the integrated value exceeds the second threshold value.

5. The driving device as defined in claim 1, wherein the drive circuit units have the same on-resistance value.

6. A driving method of a recording head having a recording element, comprising:

a recording data integration step of determining an integrated value of a number of recording actions of the recording element according to recording data;

a drive circuit unit selection step of selecting at least one of a plurality of drive circuit units in an output circuit block having a structure in which the drive circuit units are connected in parallel to the recording element and respectively have transistors of which output terminals are connected to the recording element, in accordance with the integrated value determined in the recording data integration step, in such a manner that an on-resistance value of the output circuit block which is a combined on-resistance of the transistors acting on the recording element is kept below a prescribed value; and a driving voltage application step of receiving power supplied from a power supply device, amplifying and converting an input signal having a prescribed voltage waveform corresponding to the recording data into a drive voltage applied to the recording element, and applying the drive voltage to the recording element through the at least one of the drive circuit units selected in the drive circuit unit selection step.

7. The driving method as defined in claim 6, further comprising:

a threshold value setting step of setting a threshold value with respect to the integrated value in accordance with a correlation between the integrated value and a temperature change in the drive circuit units, wherein in the drive circuit unit selection step, the integrated value is compared with the threshold value set in the threshold value setting step and only one of the drive circuit units is selected in a case where the integrated value is not more than the threshold value, and at least two of the drive circuit units are selected in a case where the integrated value exceeds the threshold value in such a manner that the on-resistance value of the output circuit block is kept below the on-resistance value of the output circuit block when the only one of the drive circuit units is selected.

8. The driving method as defined in claim 7, further comprising:

a temperature determination step of determining an ambient temperature; and a threshold value correction step of correcting the previously set threshold value to a smaller value, when the temperature determined in the temperature determination step is higher than a previously established reference temperature.

9. The driving method as defined in claim 6, wherein:

the output circuit block has the structure in which three of the drive circuit units are connected in parallel to the recording element;

the driving method further comprises a threshold value setting step of setting first and second threshold values with respect to the integrated value in accordance with a correlation between the integrated value and a temperature change in the drive circuit units, the second threshold value being larger than the first threshold value; and in the drive circuit unit selection step, the integrated value is compared with the first and second threshold values set in the threshold value setting step and only one of the drive circuit units is selected in a case where the integrated value is not more than the first threshold value, two of the drive circuit units are selected in a case where the integrated value exceeds the first threshold value and is not more than the second threshold value in such a manner that the on-resistance value of the output circuit block is kept below the on-resistance value of the output circuit block when the only one of the drive circuit units is selected, and three of the drive circuit units are selected in a case where the integrated value exceeds the second threshold value.

10. The driving method as defined in claim 6, wherein the drive circuit units have the same on-resistance value.

11. An image recording apparatus, comprising:

a recording head which has a recording element recording an image onto a recording medium;

a driving circuit which drives the recording element; and a power supply device which supplies power to the driving circuit, wherein the driving circuit includes:

an output circuit block which is supplied with the power from the power supply device, and amplifies and converts an input signal having a prescribed voltage waveform corresponding to recording data into a drive voltage applied to the recording element, the output circuit block having a structure in which a plurality of drive circuit units are connected in parallel to the recording element and respectively have transistors of which output terminals are connected to the recording element;

a recording data integration device which determines an integrated value of a number of recording actions of the recording element according to the recording data; and a drive circuit unit selection device which selects at least one of the drive circuit units in accordance with the integrated value determined by the recording data integration device, in such a manner that an on-resistance value of the output circuit block which is a combined on-resistance of the transistors acting on the recording element is kept below a prescribed value.

12. The image recording apparatus as defined in claim 11, further comprising:

a threshold value setting device which sets a threshold value with respect to the integrated value in accordance with a correlation between the integrated value and a temperature change in the drive circuit units, wherein the drive circuit unit selection device compares the integrated value with the threshold value set by the threshold value setting device and selects only one of the drive circuit units in a case where the integrated value is not more than the threshold value, and selects at least two of the drive circuit units in a case where the integrated value exceeds the threshold value in such a manner that the on-resistance value of the output circuit block is kept below the on-resistance value of the output circuit block when the only one of the drive circuit units is selected.

13. The image recording apparatus as defined in claim 12, further comprising:

a temperature determination element which determines an ambient temperature; and a threshold value correction device which corrects the previously set threshold value to a smaller value, when the temperature determined by the temperature determination element is higher than a previously established reference temperature.

14. The image recording apparatus as defined in claim 11, wherein:

the output circuit block has the structure in which three of the drive circuit units are connected in parallel to the recording element;

the driving device further comprises a threshold value setting device which sets first and second threshold values with respect to the integrated value in accordance with a correlation between the integrated value and a temperature change in the drive circuit units, the second threshold value being larger than the first threshold value; and the drive circuit unit selection device compares the integrated value with the first and second threshold values set by the threshold value setting device and selects only one of the drive circuit units in a case where the integrated value is not more than the first threshold value, selects two of the drive circuit units in a case where the integrated value exceeds the first threshold value and is not more than the second threshold value in such a manner that the on-resistance value of the output circuit block is kept below the on-resistance value of the output circuit block when the only one of the drive circuit units is selected, and selects three of the drive circuit units in a case where the integrated value exceeds the second threshold value.

15. The image recording apparatus as defined in claim 11, wherein the drive circuit units have the same on-resistance value.

* * * * *